US012565348B2

(12) United States Patent
Kato et al.

(10) Patent No.: US 12,565,348 B2
(45) Date of Patent: Mar. 3, 2026

(54) BAGMAKING AND PACKAGING APPARATUS

(71) Applicant: ISHIDA CO., LTD., Kyoto (JP)

(72) Inventors: Atsuya Kato, Ritto (JP); Takafumi Ohtani, Ritto (JP); Hiroki Fujihara, Ritto (JP)

(73) Assignee: ISHIDA CO., LTD., Kyoto (JP)

( * ) Notice: Subject to any disclaimer, the term of this patent is extended or adjusted under 35 U.S.C. 154(b) by 0 days.

(21) Appl. No.: 19/037,149

(22) Filed: Jan. 25, 2025

(65) Prior Publication Data

US 2025/0250048 A1 Aug. 7, 2025

(30) Foreign Application Priority Data

Feb. 1, 2024 (JP) ..... 2024-014252

(51) Int. Cl.
*B65B 41/18* (2006.01)
*B65B 9/02* (2006.01)
(Continued)

(52) U.S. Cl.
CPC ..... *B65B 41/18* (2013.01); *B65B 9/02* (2013.01); *B65B 57/04* (2013.01); *B65B 61/06* (2013.01); *B65B 61/26* (2013.01)

(58) Field of Classification Search
CPC B65B 41/18; B65B 9/20; B65B 57/04; B65B 61/26; B65B 9/207;
(Continued)

(56) References Cited

U.S. PATENT DOCUMENTS 4,316,566 A * 2/1982 Arleth ..... B65B 41/18 226/137
4,545,174 A * 10/1985 Seko ..... B65B 41/18 53/51
(Continued)

FOREIGN PATENT DOCUMENTS

JP 2008-127092 A 6/2008
JP 2008127093 A 6/2008
(Continued)

OTHER PUBLICATIONS

Extended European Search Report issued in European application No. 25154575.2, issued Jul. 9, 2025, 5 pages.

*Primary Examiner* — Stephen F. Gerrity
*Assistant Examiner* — Nicholas E Igbokwe
(74) *Attorney, Agent, or Firm* — United IP Counselors, LLC

(57) ABSTRACT

A bagmaking and packaging apparatus includes a transport unit configured to transport a first film or a second film in a film transport direction, a register mark detection unit configured to detect a register mark for position alignment, a bagmaking and packaging unit configured to make an individual packaging bag by cutting the first film or the second film by using a position of the register mark as a reference, and a connection unit configured to form a connection portion. In the first film, in a case where a pitch between a first register mark and a second register mark is shorter than a register mark pitch set in advance, the bagmaking and packaging unit cuts the second film based on a position of a third register mark.

5 Claims, 6 Drawing Sheets

(51) Int. Cl.
*B65B 57/04* (2006.01)
*B65B 61/06* (2006.01)
*B65B 61/26* (2006.01)

(58) Field of Classification Search
CPC ..... B65H 2301/461; B65H 2701/1241; B65H 2511/114; B65H 2553/51
See application file for complete search history.

(56) References Cited

U.S. PATENT DOCUMENTS

| | | | | | |
|---|---|---|---|---|---|
| 4,705,225 | A * | 11/1987 | Miyazaki | B65H 19/1873 | 83/650 |
| 5,388,387 | A * | 2/1995 | McElvy | B65B 9/207 | 242/421 |
| 6,096,150 | A * | 8/2000 | Ohno | B65H 19/1868 | 242/554.6 |
| 10,399,724 | B2 * | 9/2019 | Aiello | B65B 55/04 | |
| 2004/0112527 | A1 * | 6/2004 | Keene | B65H 23/1886 | 156/304.6 |
| 2011/0023423 | A1 * | 2/2011 | Iwasaki | B65H 20/10 | 53/510 |
| 2018/0057199 | A1 * | 3/2018 | Aiello | B65B 55/04 | |
| 2019/0352116 | A1 * | 11/2019 | Hoshikawa | H05K 13/086 | |
| 2020/0108958 | A1 * | 4/2020 | Shimoda | B65B 43/06 | |
| 2020/0108960 | A1 * | 4/2020 | Shimoda | B65B 51/16 | |

FOREIGN PATENT DOCUMENTS

| | | | |
|---|---|---|---|
| JP | 2009-161228 | A | 7/2009 |
| JP | 2020090311 | A | 6/2020 |

* cited by examiner

BAGMAKING AND PACKAGING APPARATUS

CROSS REFERENCE TO RELATED APPLICATIONS

This application claims the benefit of priority to Japanese Patent Application Number 2024-14252 filed on Feb. 1, 2024. The entire contents of the above-identified application are hereby incorporated by reference.

TECHNICAL FIELD

One aspect of the present disclosure relates to a bagmaking and packaging apparatus.

BACKGROUND

Japanese Unexamined Patent Publication No. 2020-90311 discloses a paper splicing method in a bagmaking, filling, and packaging machine. By using this paper splicing method, after forming a trailing end of an old strip-shaped packaging material, a leading end of a new strip-shaped packaging material to be fed from a new packaging material roll and the trailing end of the old strip-shaped packaging material pulled back on the new packaging material roll can be butted on a surface of the new packaging material roll. Therefore, an operator can butt and connect the trailing end of the old strip-shaped packaging material and the leading end of the new strip-shaped packaging material while visually recognizing the trailing end of the old strip-shaped packaging material and the leading end of the new strip-shaped packaging material on the surface of the new packaging material roll.

SUMMARY

In the packaging material used in Japanese Unexamined Patent Publication No. 2020-90311 and the like, in addition to the paper splicing described above, marks (register marks) such as characters and figures for position alignment used in a bagmaking operation or the like of the packaging material may be printed at certain intervals (pitches). In a case where a paper splicing method of adjusting a position of a connection portion (seam) between the packaging materials is adopted using such a register mark, there are problems such as a problem in which control and a configuration of the device are complicated and cause an increase in cost, and a problem in which it takes time to execute the paper splicing. From the viewpoint of avoiding such problems, it is also desired to realize an automatic paper splicing method in which the position of the connection portion is not adjusted.

Meanwhile, in a case where the packaging materials are connected to each other without adjusting the position of the connection portion, the pitch between the register marks may be irregular in the vicinity of the seam between the packaging materials. In a case where the pitch between the two adjacent register marks with the seam interposed therebetween is shortened, it is necessary to perform control such as temporarily slowing down a transport speed of the packaging material. Therefore, an individual packaging bag as a product cannot be manufactured at a certain speed, which causes an increase in cost of the product. Therefore, in a case where the seam is detected, control of not using the register mark located immediately after the seam is considered. In a case where this control is used, in a case where the pitch between the two adjacent register marks with the seam interposed therebetween is long, the amount of packaging material used for defective products is increased, which causes an increase in cost of the product.

An object of one aspect of the present disclosure is to provide a bagmaking and packaging apparatus capable of suppressing a decrease in productivity and an increase in cost for making an individual packaging bag even in a case where a connection portion between films is formed without adjusting a position of the connection portion.

(1) According to one aspect of the present disclosure, there is provided a bagmaking and packaging apparatus including: a first holding unit configured to hold a first film roll around which a first film is wound; a second holding unit configured to hold a second film roll around which a second film is wound; a transport unit configured to transport the first film or the second film in a film transport direction; a register mark detection unit configured to detect a register mark for position alignment printed on each of the first film and the second film; a bagmaking and packaging unit configured to make an individual packaging bag, by cutting the first film or the second film by using positions of the register marks detected by the register mark detection unit as a reference after shaping the first film or the second film to form a bag-shaped body in which an article is to be accommodated; and a connection unit configured to form a connection portion for connecting the first film and the second film, in which in a case where: in the first film, in the film transport direction, the register mark closest to the connection portion is defined as a first register mark; and in the second film, in the film transport direction, the register mark closest to the connection portion is defined as a second register mark and the register mark located immediately after the second register mark is defined as a third register mark, the bagmaking and packaging unit is configured to cut the second film by using a position of the third register mark as a reference to make the individual packaging bag in a case where a pitch between the first register mark and the second register mark is shorter than a register mark pitch set in advance, and cut the second film by using a position of the second register mark as a reference to make the individual packaging bag in a case where the pitch is longer than the register mark pitch set in advance.

In the bagmaking and packaging apparatus, the bagmaking and packaging unit is configured to cut the second film by using the position of the third register mark as a reference to make the individual packaging bag in a case where the pitch between the first register mark and the second register mark is shorter than the register mark pitch set in advance, and cut the second film by using the position of the second register mark as a reference to make the individual packaging bag in a case where the pitch is longer than the register mark pitch set in advance. In this case, the second film can be cut at an appropriate location without changing a transport speed of each film in accordance with the pitch between the first register mark and the second register mark with the connection portion interposed therebetween. Therefore, by using the bagmaking and packaging apparatus described above, even in a case where the connection portion is formed without adjusting a position of the connection portion between the films, it is possible to suppress a decrease in productivity and an increase in cost for making an individual packaging bag.

(2) The bagmaking and packaging apparatus according to (1), may further include: a connection portion detection unit configured to detect the connection portion upstream of the register mark detection unit in the film transport direction. In this case, it is possible to prevent the connection portion from being erroneously detected as the register mark.

(3) In the bagmaking and packaging apparatus according to (2), each of the register mark detection unit and the connection portion detection unit may include a photoelectric sensor. In this case, it is possible to appropriately prevent the connection portion from being erroneously detected as the register mark.

(4) In the bagmaking and packaging apparatus according to (2) or (3), the register mark detection unit or the connection portion detection unit may be configured to detect a position of the connection portion based on a change in an output detection signal. In this case, it is possible to appropriately prevent the connection portion from being erroneously detected as the register mark.

(5) The bagmaking and packaging apparatus according to any one of (2) to (4), may further include: a printing unit configured to print on the first film or the second film based on a detection result of the connection portion detection unit. In this case, occurrence of a defective product due to a printing defect of the individual packaging bag can be suppressed.

According to one aspect of the present disclosure, it is possible to provide a bagmaking and packaging apparatus capable of suppressing a decrease in productivity and an increase in cost for making an individual packaging bag even in a case where a connection portion is formed without adjusting a position of the connection portion between films.

DETAILED DESCRIPTION

Figure 1:
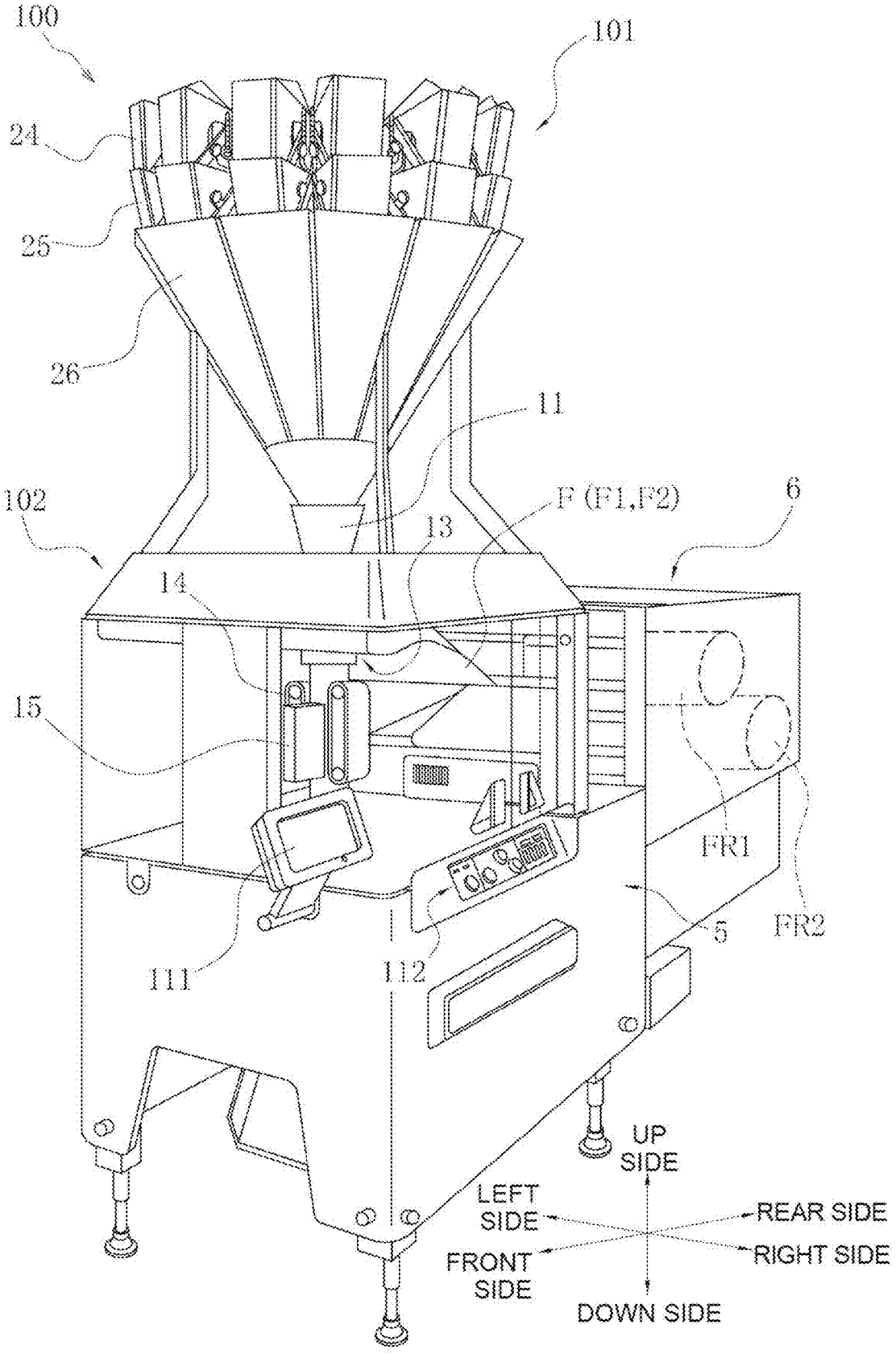
FIG. 1 is an external perspective view illustrating a weighing bagmaking and packaging system including a bagmaking and packaging apparatus.

Hereinafter, appropriate embodiments of the present disclosure will be described in detail with reference to the accompanying drawings. In the description of the drawings, the same or corresponding elements are denoted by the same reference numerals, and the repeated description will be omitted. In the following description, "front", "rear", "up", "down", "left", "right", and the like may be used to indicate directions. In the present embodiment, the terms "front", "rear", "up", "down", "left", and "right" are defined by an orientation of arrows attached to the drawings. In addition, "A or B" in the present specification may include either A or B, and does not exclude the inclusion of both A and B.

Overview of Weighing, Bagmaking and Packaging System

Figure 2:
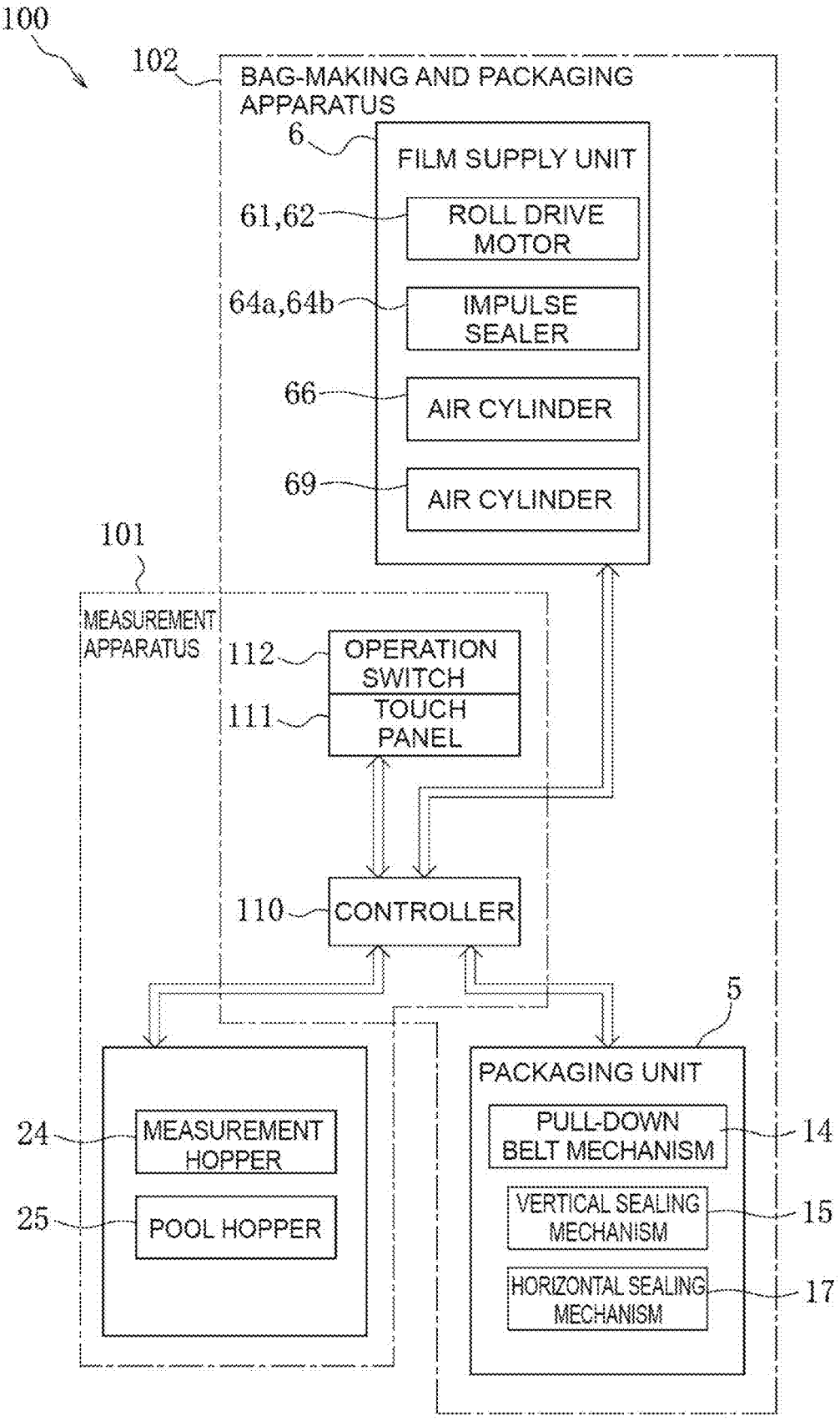
FIG. 2 is a diagram illustrating a part of a control block of the weighing bagmaking and packaging system.

FIG. 1 is an external perspective view illustrating a weighing bagmaking and packaging system including a bagmaking and packaging apparatus. FIG. 2 is a diagram illustrating a part of a control block of the weighing bagmaking and packaging system. As illustrated in FIGS. 1 and 2, a weighing bagmaking and packaging system 100 accommodates a weighed article C in a formed body of a film F, and makes a bag of the formed body to manufacture a bagged individual packaging bag. The weighing bagmaking and packaging system 100 includes a weighing apparatus 101 and a bagmaking and packaging apparatus 102. The bagmaking and packaging apparatus 102 is disposed below the weighing apparatus 101. In an example, a touch panel 111 and an operation switch 112 capable of integrally operating the bagmaking and packaging apparatus 102 and the weighing apparatus 101 are installed at the bagmaking and packaging apparatus 102. As illustrated in FIG. 2, in the weighing bagmaking and packaging system 100, an operation of the weighing apparatus 101 and an operation of the bagmaking and packaging apparatus 102 are controlled by a controller 110 included in the bagmaking and packaging apparatus 102, but the present invention is not limited thereto.

Film

Figure 3A:
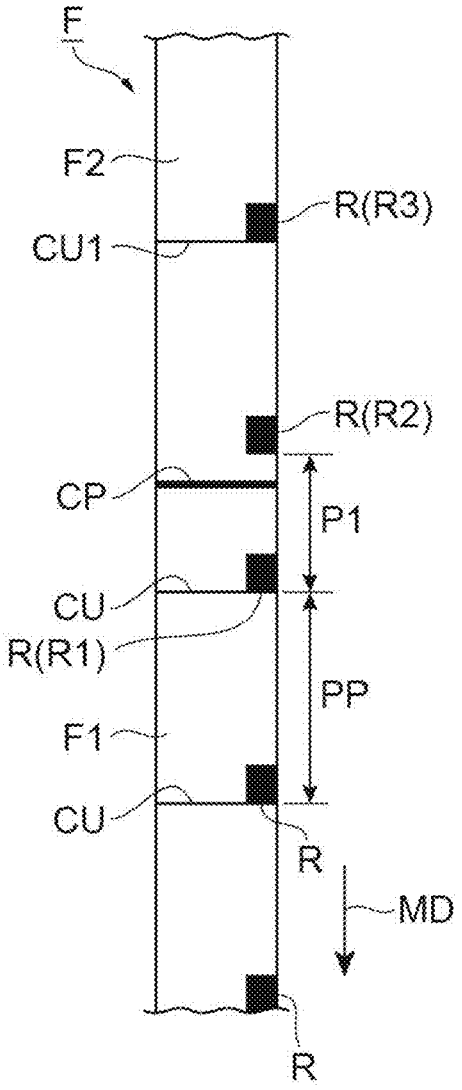
FIG. 3A is a schematic plan view illustrating an example of a main part of a film.
Figure 3B:
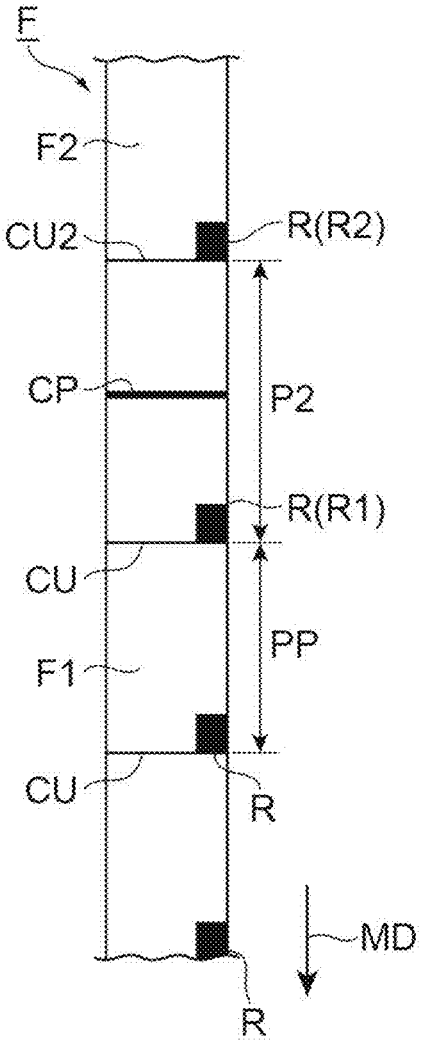
FIG. 3B is a schematic plan view illustrating another example of the main part of the film.

FIG. 3A is a schematic plan view illustrating an example of a main part of a film F, and FIG. 3B is a schematic plan view illustrating another example of the main part of the film F. The film F illustrated in FIGS. 2 and 3A and 3B corresponds to a member in which a first film F1 fed from a first film roll FR1 and a second film F2 fed from a second film roll FR2, which will be described below, are integrated at a connection portion CP. In the film F illustrated in FIGS. 3A and 3B, the first film F1 is located downstream of the second film F2 in a transport direction MD, but the present invention is not limited thereto. The first film F1 is located upstream of the second film F2 in the transport direction MD, depending on an operation timing of the bagmaking and packaging apparatus 102. Hereinafter, even in a case where the first film F1 and the second film F2 do not need to be distinguished from each other, the first film F1 and the second film F2 can be simply referred to as the film F. A plurality of register marks R are printed on each of the first film F1 and the second film F2. The register mark R is a sign for position alignment used for making or the like a bag B. In each of the first film F1 and the second film F2, pitches of the plurality of register marks R along the transport direction MD are constant. In addition, the pitch in the first film F1 and the pitch in the second film F2 are the same, and are stored in a storage device of the controller 110 as a preset value (register mark pitch PP). In addition to the register mark R, a character, a pattern, a design, and the like (not illustrated) can be printed on the film F.

Figure 6:
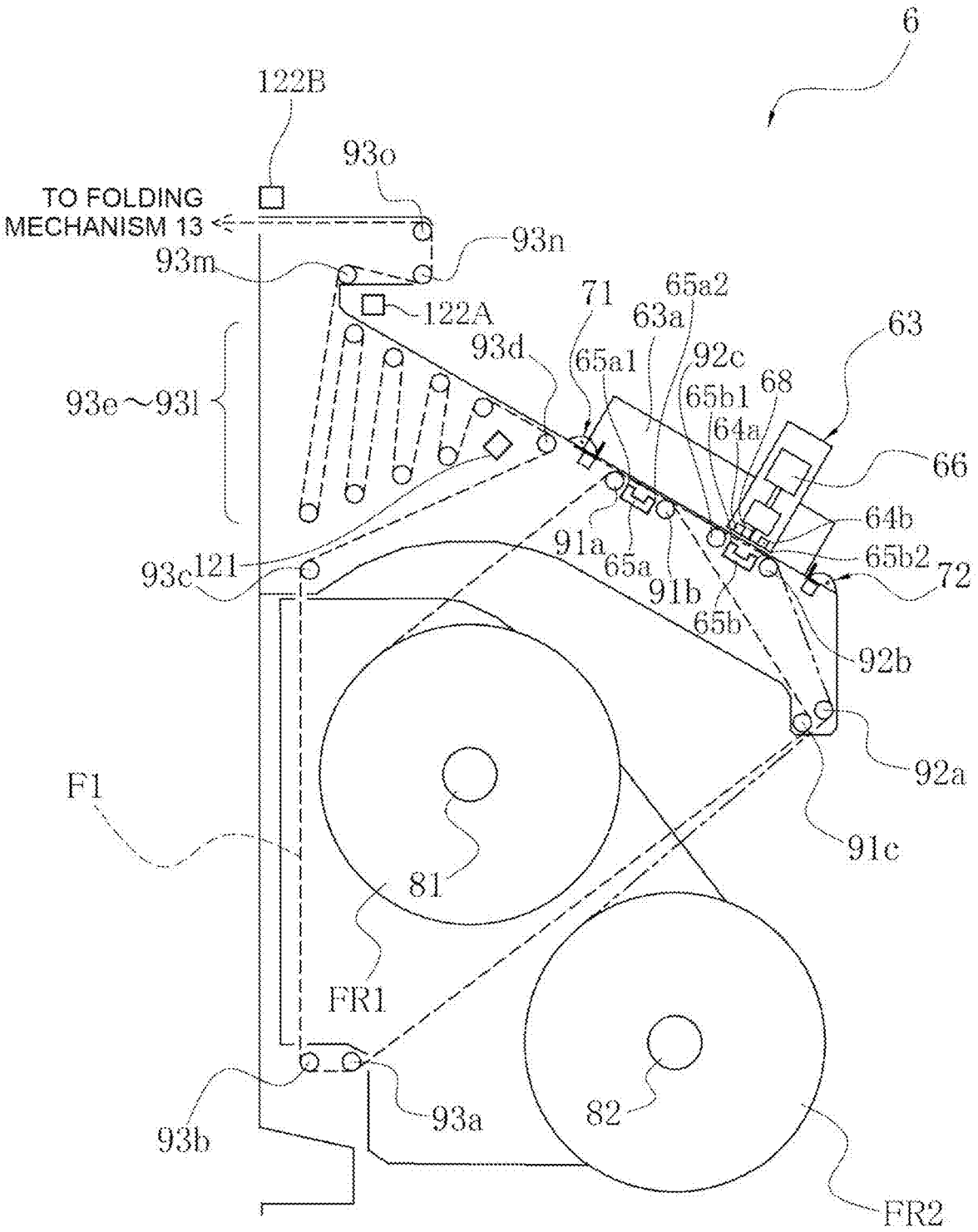
FIG. 6 is a schematic side view of the film supply unit.

In FIGS. 3A and 3B, in the first film F1, the register mark R closest to the connection portion CP in the transport direction MD is defined as a first register mark R1. In addition, in the second film F2, the register mark R closest to the connection portion CP in the transport direction MD is defined as a second register mark R2. In addition, in FIG. 3A, the register mark R located immediately after the second register mark R2 is defined as a third register mark R3. In FIG. 3A, a pitch P1 between the first register mark R1 and the second register mark R2 adjacent to each other with the connection portion CP interposed therebetween is shorter than the register mark pitch PP. In FIG. 3B, a pitch P2 between the first register mark R1 and the second register mark R2 adjacent to each other with the connection portion CP interposed therebetween is longer than the register mark pitch PP. Each of FIG. 3A and FIG. 3B illustrates scheduled cutting portions CU, CU1, and CU2, which are portions to be cut later, and the register mark pitch PP set in advance, which is stored in the storage device of the controller 110. Each of the scheduled cutting portions CU, CU1, and CU2 is set along the corresponding register mark R in accordance with a predetermined condition. In the present embodiment, in an example, the scheduled cutting portions CU, CU1, and CU2 are set based on deviation information (details will be described below) output from register mark detection units 122A and 122B (see FIG. 6) to be described below. As illustrated in FIG. 3A, since the pitch P1 is shorter than the register mark pitch PP, the scheduled cutting portion CU1 is first set in the second film F2 by using the third register mark R3 instead of the second register mark R2, as a reference. As illustrated in FIG. 3B, since the pitch P2 is longer than the register mark pitch PP, the scheduled cutting portion CU2 is first set in the second film F2 by using the second register mark R2, as a reference. Each scheduled cutting portion is set by, for example, the controller 110.

Weighing Apparatus

Figure 4:
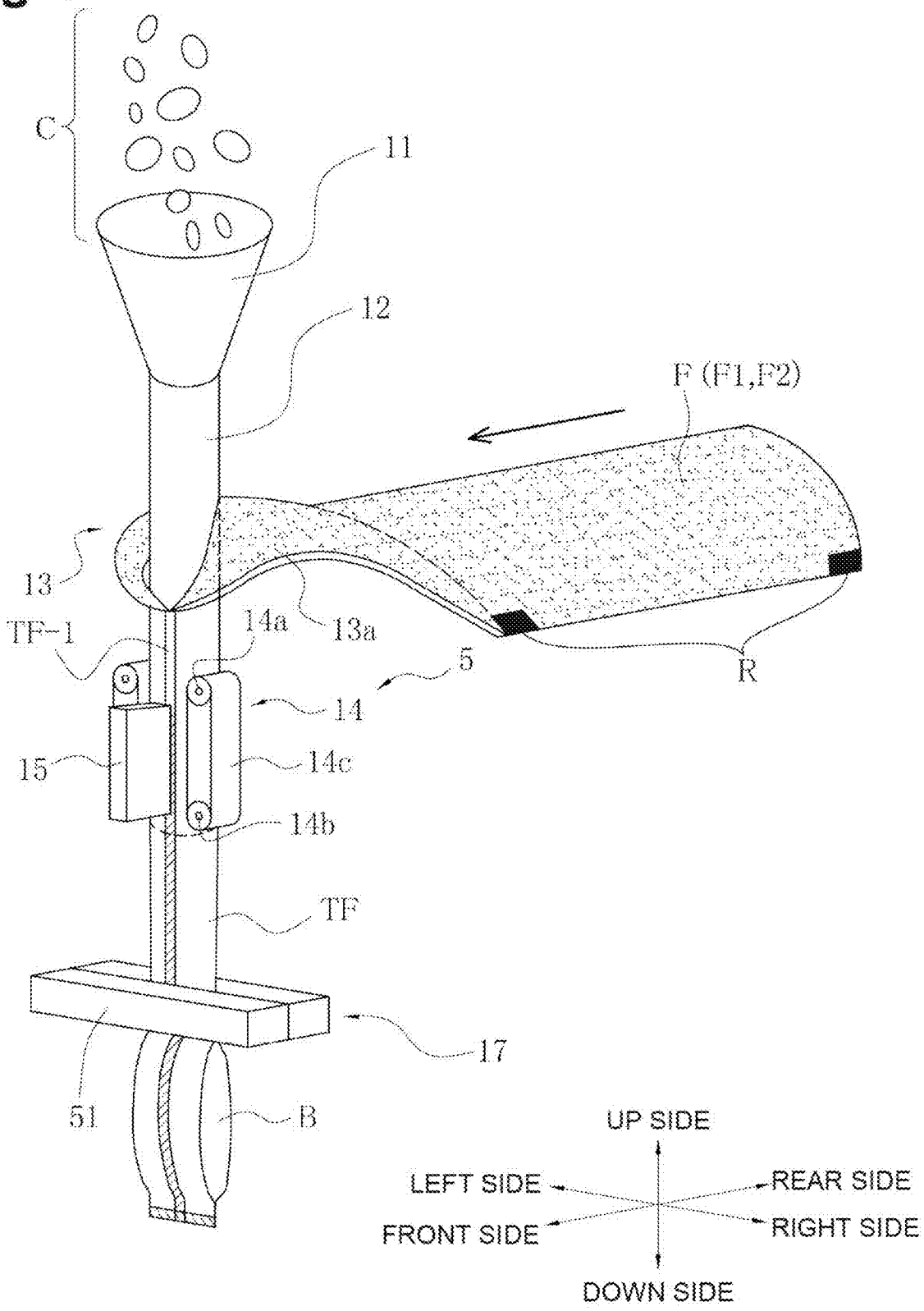
FIG. 4 is a schematic perspective view illustrating a main configuration of a bagmaking and packaging unit.

The weighing apparatus 101 is, for example, a well-known combination scale, and has a plurality of pool hoppers 24, a plurality of weighing hoppers 25 located below the plurality of pool hoppers 24, and a collecting chute 26 located below the plurality of weighing hoppers 25. The article C, which is a target (object to be packaged) of the weighing and packaging of the weighing bagmaking and packaging system 100, is, for example, food such as snack food as illustrated in FIG. 4. In a case of weighing and packaging the article C, first, the article C is supplied to an upper center of the weighing apparatus 101. Next, the article C is supplied to the corresponding weighing hopper 25 via the plurality of pool hoppers 24 disposed at a trailing end of each path after being dispersed in a plurality of radial paths. Some of the weighing hoppers 25 are selected such that a weight of the article C weighed by each weighing hopper 25 is within a predetermined range. The article C accommodated in the selected weighing hopper 25 is discharged to the collecting chute 26, based on a discharge request signal from the controller 110. The article C discharged from the collecting chute 26 is supplied to the bagmaking and packaging apparatus 102.

Bagmaking and Packaging Apparatus

As described above, the bagmaking and packaging apparatus 102 includes a packaging unit 5 (bagmaking and packaging unit) that bags the article C to manufacture a product, a film supply unit 6 that supplies the film F to the packaging unit 5, and the controller 110 that controls operations of the packaging unit 5 and the film supply unit 6. The article C discharged from the weighing apparatus 101 falls into an inner space of a tube 12 included in the packaging unit 5 through a funnel member 11 mounted on the packaging unit 5. Then, the article C falls into the inner space of the tube 12. The bagmaking and packaging apparatus 102 accommodates the article C via the tube 12 in a tubular film TF (details will be described below), and then horizontally seals a lower end portion of the tubular film TF and an upper end portion of the preceding bag B (individual packaging bag), simultaneously. Accordingly, the bag B in which the article C is accommodated is made. The film supply unit 6 is a unit that supplies a sheet-shaped film F to a folding mechanism 13 of the packaging unit 5, and is located behind the packaging unit 5. The film supply unit 6 is located upstream of the packaging unit 5 in the transport direction MD (film transport direction) of the film F.

As illustrated in FIGS. 1, 2, and 4, the packaging unit 5 is a unit that forms the tubular film TF, which is a bag-shaped body in which the article C is accommodated, by shaping the film F, and then cuts the film F to make the bag B that accommodates the article C. The packaging unit 5 includes the folding mechanism 13 that folds the sheet-shaped film F into the tubular film TF, a pull-down belt mechanism 14 that transports a film (tubular film TF) folded in a tubular shape downward, a vertical sealing mechanism 15 that vertically seals an overlapping portion TF-1 at both ends of the tubular film TF, and a horizontal sealing mechanism 17.

The folding mechanism 13 includes the tube 12 that guides the article C into the tubular film TF, and a former 13*a* that is disposed to surround a lower portion of the tube 12. The film F supplied from the film supply unit 6 is folded in a tubular shape along an outer peripheral surface of the tube 12 when passing through a gap between the former 13*a* and the tube 12. In this case, an upper surface of the film F is an inner peripheral surface of the tubular film TF, and a lower surface of the film F is an outer peripheral surface of the tubular film TF.

The pull-down belt mechanism 14 having a pair of belts 14*c* disposed on both left and right sides of the tube 12 is a mechanism that picks up the tubular film TF wound around the tube 12 and transports the tubular film TF downward. The pull-down belt mechanism 14 functions as a transport unit that transports the film F together with the film supply unit 6.

The vertical sealing mechanism 15 is a member that heats and seals the overlapping portion TF-1 at both ends of the tubular film TF while pressing the overlapping portion TF-1 against the tube 12 with a certain pressure. The vertical sealing mechanism 15 has, for example, a heater block (not illustrated) and a metal belt (not illustrated) that can travel in synchronization with the tubular film TF around the heater block.

The horizontal sealing mechanism 17 horizontally seals the bag B formed of the tubular film TF, and simultaneously heats and seals an upper end portion of the bag B and a lower end portion of a subsequent bag (tubular film TF). The horizontal sealing mechanism 17 horizontally seals the tubular film TF, for example, in a state in which the article C falls into the tubular film TF through an inside of the tube 12. Accordingly, the bag B that accommodates the article C is formed. The horizontal sealing mechanism 17 is configured with a pair of sealing jaws 51 incorporating a heater and a drive mechanism (not illustrated) that brings the pair of sealing jaws 51 close to and away from each other with respect to the tubular film TF. The horizontal sealing mechanism 17 has a cutter (not illustrated) that cuts the first film F1 or the second film F2. The cutter is a member that separates the bag B and the subsequent tubular film FT, and cuts a predetermined portion (for example, the scheduled cutting portion CU illustrated in FIGS. 3A and 3B) of a horizontal sealing portion formed on the tubular film FT. Accordingly, it is possible to prevent a deviation of a character, a pattern, and the like printed on the bag B.

As illustrated in FIGS. 1, 2, and 4 to 6, the film supply unit 6 has a first holding unit 81, a second holding unit 82, a plurality of rollers 91*a*, 91*b*, 91*c*, 92*a*, 92*b*, 92*c*, and 93*a* to 93*o*, roll drive motors 61 and 62, a film switching unit 63, a connection portion detection unit 121, and register mark detection units 122A and 122B. An example of the device configuration and operation of the film supply unit 6 is disclosed in, for example, Japanese Patent Application No. 2023-192268, the entire content of which is incorporated herein by reference.

The first holding unit 81 is an air chuck that holds the first film roll FR1 around which the first film F1 is wound. Installation or the like of the first film roll FR1 to the first holding unit 81 may be manually executed by an operator or may be automatically executed by a mechanism (not illustrated) or another apparatus. The second holding unit 82 is an air chuck that holds the second film roll FR2 around which the second film F2 is wound. Installation or the like of the second film roll FR2 to the second holding unit 82 may be manually executed by the operator or may be automatically executed by the mechanism or the other device (not illustrated). In the latter case, the installation may be executed automatically or semi-automatically. Each of the first holding unit 81 and the second holding unit 82 is configured to be rotatable by the roll drive motors 61 and 62.

The roll drive motors 61 and 62 are members that rotate the first holding unit 81 and the second holding unit 82, and function as a transport unit that transports the film F together with the pull-down belt mechanism 14. The first film F1 is fed from the first film roll FR1 by the rotation of the first holding unit 81. In the same manner, the second film F2 is fed from the second film roll FR2 by the rotation of the second holding unit 82. In an example, the roll drive motor 61 has a mechanism for detecting the remaining amount of the first film F1 wound around the first film roll FR1. In the same manner, the roll drive motor 62 may have a mechanism that detects the remaining amount of the second film F2 wound around the second film roll FR2. A detection result of these mechanisms is output to, for example, the controller 110. Accordingly, it is possible to automatically switch the films by a mechanism (not illustrated) while suppressing influence on the bagmaking and packaging by the weighing bagmaking and packaging system 100.

The plurality of rollers 91*a*, 91*b*, 91*c*, 92*a*, 92*b*, 92*c*, and 93*a* to 93*o* are rollers that guide the first film F1 or the second film F2, and function as a transport unit that transports the film F, together with the roll drive motors 61 and 62 and the pull-down belt mechanism 14. In an example, the first film F1 fed from the first film roll FR1 is guided by the rollers 91*a*, 91*b*, and 91*c*, and is further guided by the roller 93*a* and the subsequent rollers. In this case, the feeding of the first film F1 from the first film roll FR1 to the roller 91*a* or the like may be manually executed by an operator or may be automatically executed by a mechanism (not illustrated) or another apparatus. In another example, the second film F2 fed from the second film roll FR2 is guided by the rollers 92*a*, 92*b*, and 92*c*, and is further guided by the roller 93*a* and the subsequent rollers. In this case, the feeding of the second film F2 from the second film roll FR2 to the roller 92*a* or the like may be manually executed by the operator or may be automatically executed by the mechanism (not illustrated) or the other device.

The film switching unit 63 is a portion for switching a film used for bagmaking and packaging. In a case of switching the film by the film switching unit 63, the bagmaking and packaging with the first film F1 or the second film F2 may be temporarily stopped or continued. In addition, as will be described below, the film switching unit 63 also functions as a connection unit that forms the connection portion CP connecting the first film F1 and the second film F2. Therefore, the film F in which the first film F1 and the second film F2 are integrated can be formed at the film switching unit 63. The film switching unit 63 includes impulse sealers 64*a* and 64*b*, sealing bases 65*a* and 65*b*, a cutter 68, and an air cylinder 66.

Figure 5:
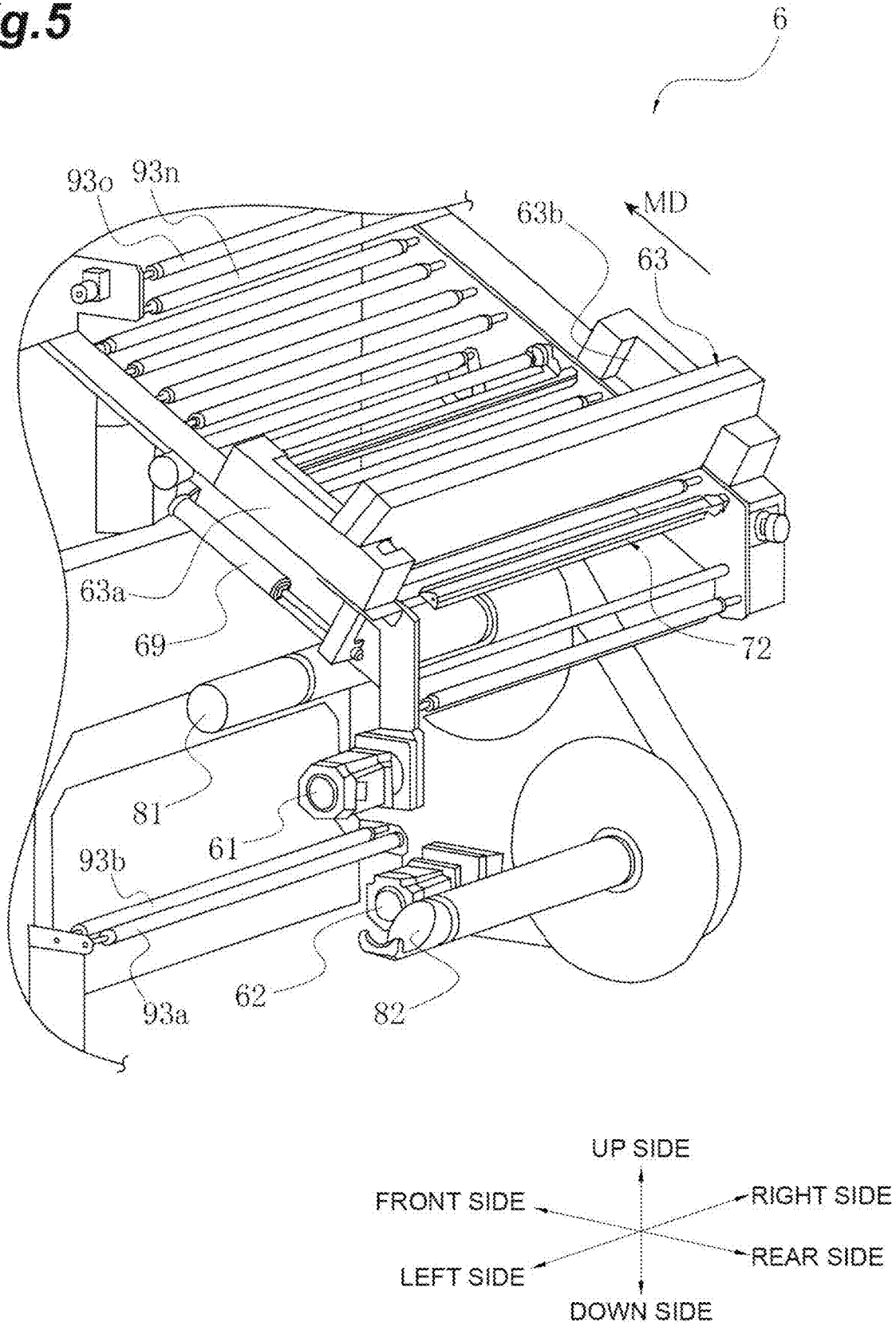
FIG. 5 is an external view of a film supply unit as viewed from a rear right side.

The impulse sealers 64*a* and 64*b* extend in a direction intersecting the transport direction MD, and are spaced from each other in the transport direction MD. The impulse sealer 64*b* is located upstream of the impulse sealer 64*a* in the transport direction MD. The cutter 68 is located between the impulse sealers 64*a* and 64*b* in the transport direction MD. The impulse sealers 64*a* and 64*b* and the cutter 68 are integrated, and are moved by the air cylinder 66. In addition, the film switching unit 63 is supported by a pair of support stands 63*a* and 63*b*. The film switching unit 63 is moved in the transport direction MD by an air cylinder 69 different from the air cylinder 66. In FIG. 5, the film switching unit 63 is disposed on a most rear side (rear end position) in the transport direction MD. The film switching unit 63 can be moved to a most front side (front end position) in the transport direction MD by the operation of the air cylinder 69.

The sealing base 65*a* is a member that faces the impulse sealers 64*a* and 64*b* of the film switching unit 63 disposed at the front end position with the film F interposed therebetween. The sealing base 65*b* is a member that faces the impulse sealers 64*a* and 64*b* of the film switching unit 63 disposed at the rear end position with the film F interposed therebetween. The sealing base 65*a* is located between the rollers 91*a* and 91*b*. The sealing base 65*b* is located between the rollers 92*b* and 92*c*. The sealing bases 65*a* and 65*b* have the same configuration. Since the configuration is the same, the sealing base 65*a* will be described below as an example. The sealing base 65*a* is divided into a first portion 65*a*1 that can face the impulse sealer 64*a* and a second portion 65*a*2 that can face the impulse sealer 64*b*. A space in which the cutter 68 can enter and exit is formed between the first portion 65*a*1 and the second portion 65*a*2.

In the film switching unit 63, for example, the first film F1 and the second film F2 overlapping each other are sandwiched by the impulse sealers 64*a*, 64*b* and the sealing base 65*a* or the impulse sealers 64*a*, 64*b* and the sealing base 65*b*. Then, the first film F1 and the second film F2 are heated and sealed, and the first film F1 and the second film F2 are cut by the cutter 68. Accordingly, in the film switching unit 63, the connection portion CP (refer to FIGS. 3A and 3B) connecting the first film F1 and the second film F2 that overlap each other is formed. In the present embodiment, in the formation of the connection portion CP, position alignment of the first film F1 and the second film F2 in the transport direction MD is not executed. Therefore, in the connection portion CP and the periphery thereof in the film F, a pitch between the register marks R along the transport direction MD may deviate from a register mark pitch stored in the storage device of the controller 110.

In the film switching unit 63, a part of the first film F1 and a part of the second film F2 are connected by the impulse sealer 64*a* and the first portion 65*a*1 or the impulse sealer 64*a* and the first portion 65*b*1, and another part of the first film F1 and another part of the second film F2 are connected by the impulse sealer 64*b* and the second portion 65*a*2 or the impulse sealer 64*b* and the second portion 65*b*2. Accordingly, a leading end of a film to be newly used (for example, the second film F2) and a peripheral portion thereof are connected to a film to be replaced. Therefore, it is not necessary to remove an unnecessary portion of the second film F2 in the film F in which the first film F1 and the second film F2 are connected (an example of the operation and effect of using the film switching unit 63 is disclosed in, for example, Japanese Patent Application No. 2023-192268).

The connection and cutting of the first film F1 and the second film F2 by the film switching unit 63 described above are executed, for example, in a case of switching from the bagmaking and packaging with the first film F1 to the bagmaking and packaging with the second film F2 and in a case of switching from the bagmaking and packaging with the second film F2 to the bagmaking and packaging with the first film F1.

The film switching unit 63 further includes a first gripping portion 71 that presses a leading end of the second film F2 and a second gripping portion 72 that presses a leading end of the first film F1. Since the first gripping portion 71 and the second gripping portion 72 have the same structure, the first gripping portion 71 will be described here. The first gripping portion 71 has a pressing member including an L-shaped member extending in a right-left direction and a base extending in the right-left direction. The pressing member is switched between a state in which the pressing member is separated from the base and a state in which the pressing member is pressed against the base by gravity, manually or automatically.

The connection portion detection unit 121 is a member that detects the connection portion CP included in the film F, and is located downstream of the film switching unit 63 in the transport direction MD. In an example, the connection portion detection unit 121 is located between the roll 93*d* and the roll 93*e* in the transport direction MD. The connection portion detection unit 121 includes, for example, a photoelectric sensor. In this case, the connection portion detection unit 121 may include a light source. Alternatively, the film supply unit 6 may include a light source facing the connection portion detection unit 121 via the film F. The connection portion detection unit 121 outputs a detection signal indicating a detection result of the film F. The detection signal is output to the controller 110. In an example, a detection signal output in a case where the connection portion CP is detected and a detection signal output in a case where a portion of the film F different from the connection portion CP is detected are different from each other. In this case, the connection portion detection unit 121 detects a position of the connection portion CP based on a change in the output detection signal.

Each of the register mark detection units 122A and 122B is a member that detects the register mark R, and is located downstream of the connection portion detection unit 121 in the transport direction MD. That is, the connection portion detection unit 121 is located upstream of the register mark detection units 122A and 122B in the transport direction MD. The register mark detection unit 122A is located upstream of the register mark detection unit 122B in the transport direction MD. In an example, the register mark detection unit 122A is located between the roll 93*l* and the roll 93*m* in the transport direction MD, and the register mark detection unit 122B is located between the roll 93*o* and the folding mechanism 13 in the transport direction MD. In an example, a pitch between the register marks R in the film F is calculated based on the detection of the register mark R by the register mark detection unit 122A. Based on a calculation result of the pitch, the presence or absence of a deviation from a register mark pitch is detected. In addition, a deviation amount from the register mark pitch stored in the controller 110 is also calculated. Information (deviation information) including the calculation result of the pitch, the presence or absence of the deviation, the deviation amount, and the like by the register mark detection unit 122A is output to, for example, the controller 110. The register mark detection unit 122B also outputs the deviation information to the controller 110. The controller 110 can issue an instruction to change the operation of the transport unit or the like described above, based on the deviation information output from the register mark detection unit 122B. Therefore, the deviation information output from the register mark detection unit 122B can correspond to information that is a trigger for changing the operation of the bagmaking and packaging apparatus 102.

In the film F illustrated in FIG. 3A, the deviation amount corresponds to the pitch P1. In the film F illustrated in FIG. 3B, the deviation amount corresponds to a difference between the pitch P2 and the register mark pitch PP. In a case where the deviation amount is equal to or higher than a predetermined threshold value, deviation correction of the film F by the transport unit is executed as described below (details will be described below).

Each of the register mark detection units 122A and 122B includes, for example, a photoelectric sensor. In this case, each of the register mark detection units 122A and 122B may include a light source. Alternatively, the film supply unit 6 may include a light source facing the register mark detection unit 122A via the film F and a light source facing the register mark detection unit 122B via the film F. Each of the register mark detection units 122A and 122B outputs a detection signal indicating a detection result of the film F. For example, the detection signal is output to the controller 110. In an example, a detection signal output in a case where the register mark R is detected and a detection signal output in a case where a portion of the film F different from the register mark R is detected are different from each other. In this case, each of the register mark detection units 122A and 122B detects the presence of the register mark R based on a change in the output detection signal. In addition, the register mark detection unit 122A or the register mark detection unit 122B may detect the connection portion CP based on a change in the output detection signal. In this case, the film supply unit 6 may not have the connection portion detection unit 121.

Controller

The controller 110 controls the weighing apparatus 101 and the bagmaking and packaging apparatus 102 individually or integrally, and is realized by a computer. The controller 110 includes a control arithmetic device and a storage device. The control arithmetic device includes a processor such as a CPU or a GPU. The control arithmetic device reads out a program stored in a storage device, and executes a predetermined image process, arithmetic process, and the like according to the program. Further, the control arithmetic device can write a computation result in a storage device or read out information stored in the storage device in accordance with the program. The information stored in the storage device is, for example, a type of article C, a type of film F, the register mark pitch PP, and the like.

The controller 110 controls each drive unit of the packaging unit 5 and the film supply unit 6 according to parameters, operating conditions, and the like set by the touch panel 111 or the like. In addition, the controller 110 controls a feeder, the pool hopper 24, the weighing hopper 25, and the like of the weighing apparatus 101. Specifically, the controller 110 takes in necessary information from the weighing apparatus 101 and various sensors mounted in the bagmaking and packaging apparatus 102, and performs various types of control based on the information.

In an example, the controller 110 controls the operation of the transport unit described above (the pull-down belt mechanism 14, the roll drive motors 61 and 62, and the like), the vertical sealing mechanism 15, the horizontal sealing mechanism 17, and the like based on a detection result of the connection portion CP output from the connection portion detection unit 121, the deviation information output from the register mark detection units 122A and 122B, and the like. For example, in a case where a deviation amount included in the deviation information input to the controller 110 is less than a predetermined threshold value, the controller 110 sets the operation of the transport unit, the vertical sealing mechanism 15, the horizontal sealing mechanism 17, and the like to a normal operation. During the normal operation, the transport unit, the vertical sealing mechanism 15, the horizontal sealing mechanism 17, and the like are repeatedly driven along a normal cycle set in advance. For example, in the normal cycle, the transport unit transports the film F by the register mark pitch PP. A transport speed of the film F in the normal cycle is constant, for example, except for a period in which heat sealing and cutting by the horizontal sealing mechanism 17 are executed (horizontal sealing and cutting period).

On the other hand, in a case where the deviation amount included in the deviation information input to the controller 110 is equal to or higher than the predetermined threshold value, the controller 110 sets the operation of the transport unit, the vertical sealing mechanism 15, the horizontal sealing mechanism 17, and the like described above, as a defective product discharge operation. Accordingly, a defective product including the connection portion CP, a defective product caused by a printing mistake of the register mark R, and the like can be accurately discharged. Therefore, it is possible to appropriately prevent mass production of a defective product in which a character, a pattern, and the like are not disposed at a predetermined position of the bag B and are printed on the film F. During the defective product discharge operation, the controller 110 controls at least one of the transport unit, the vertical sealing mechanism 15, the horizontal sealing mechanism 17, and the like to perform an operation different from the normal operation. In addition, during the defective product discharge operation, the controller 110 may also control the operation of the weighing apparatus 101 to be an operation different from the normal operation.

During the defective product discharge operation, the transport unit may transport the film F by the deviation amount in addition to the register mark pitch PP. In this case, deviation correction of the film F is executed, during the defective product discharge operation. Accordingly, the deviation of the film F is eliminated during the defective product discharge operation. The transport speed of the film F may be constant or variable, except for the horizontal sealing and cutting period during the defective product discharge operation. In the former case, the transport speed of the film F during the defective product discharge operation may be the same as the transport speed of the film F during the normal operation, except for the horizontal sealing and cutting period. In the latter case, for example, the transport speed of the film F during the defective product discharge operation may be changed such that a period of the defective product discharge operation matches a period of the normal cycle. The change is executed, for example, before or after the horizontal sealing and cutting period during the defective product discharge operation. In this case, since the operation of the vertical sealing mechanism 15 and the horizontal sealing mechanism 17 in the normal operation and the defective product discharge operation can be made the same, the control of the bagmaking and packaging apparatus 102 can be simplified.

The normal operation and the defective product discharge operation may be continuously executed. Here, in a case where the transport speed of the film F during the defective product discharge operation is the same as the transport speed of the film F during the normal operation, except for the horizontal sealing and cutting period, the continuous execution of the normal operation and the defective product discharge operation is executed appropriately. A stop time of the bagmaking and packaging apparatus 102 may be set between the normal operation and the defective product discharge operation. In this case, for example, after completion of the defective product discharge operation, the normal operation is resumed after a predetermined period. In a case where the deviation correction of the film F is not executed during the defective product discharge operation, the deviation correction, the register mark alignment correction, or the like may be executed after the defective product discharge operation and before the normal operation is resumed, or after the normal operation and before the defective product discharge operation is started. In these cases, the transport speed of the film F may be the same as or different from the transport speed of the film F in the normal operation.

After the normal operation and before a start of the defective product discharge operation, during the defective product discharge operation, or after the defective product discharge operation and before a resumption of the normal operation, the transport unit may transport the film F of one or a plurality of register mark pitches PP in addition to the deviation amount. In this case, a bag including the connection portion CP can be discharged in a state of the connected package bag. Accordingly, it is possible to reliably exclude the defective product including the connection portion CP.

With the bagmaking and packaging apparatus 102 according to the present embodiment described above, as illustrated in FIG. 3A, in a case where the pitch P1 is shorter than the register mark pitch PP, the second film F2 is cut by using a position of the third register mark R3 as a reference to make the bag B, and as illustrated in FIG. 3B, in a case where the pitch P2 is longer than the register mark pitch PP, the second film F2 is cut by using a position of the second register mark R2 as a reference to make the bag B. As illustrated in FIG. 3A, in a case where the pitch P1 is shorter than the register mark pitch PP, during the defective product discharge operation, the second film F2 is first cut along the scheduled cutting portion CU1 set by using the position of the third register mark R3 as a reference. That is, during the defective product discharge operation, the second film F2 is not cut by using the position of the second register mark R2 as a reference. On the other hand, as illustrated in FIG. 3B, in a case where the pitch P2 is longer than the register mark pitch PP, during the defective product discharge operation, the second film F2 is first cut along the scheduled cutting portion CU2 set by using the position of the second register mark R2 as a reference. Therefore, in the present embodiment, the second film F2 can be cut at an appropriate location during the defective product discharge operation in accordance with a pitch between the first register mark R1 and the second register mark R2 with the connection portion CP interposed therebetween. Accordingly, even in a case where a mechanism for executing position alignment between the first film F1 and the second film F2 is not included in the bagmaking and packaging apparatus 102, a deviation of a character, a pattern, and the like printed on the bag B due to the formation of the connection portion CP can be prevented, and a lot of defective products are less likely to be manufactured. Therefore, even in a case where the connection portion CP is formed without adjusting the position of the connection portion CP between the first film F1 and the second film F2, it is possible to suppress a decrease in productivity and an increase in cost for making the bag B.

In addition, in the present embodiment, the normal operation and the defective product discharge operation are continuously executed, and the transport speed of the film F during the defective product discharge operation may be the same as the transport speed of the film F during the normal operation, except for the horizontal sealing and cutting period. In this case, the second film F2 can be cut at an appropriate location during the defective product discharge operation without changing the transport speed of the film F between the normal operation and the defective product discharge operation. Accordingly, the normal operation and the defective product discharge operation are appropriately and continuously performed, and a stop period or the like of the bagmaking and packaging apparatus 102 in the execution of the defective product discharge operation can be significantly shortened. Therefore, it is possible to appropriately suppress a decrease in productivity and an increase in cost for making the bag B.

In an example, the bagmaking and packaging apparatus 102 includes the connection portion detection unit 121 that detects the connection portion CP upstream of the register mark detection units 122A and 122B in the transport direction MD. Therefore, it is possible to prevent the connection portion CP from being erroneously detected as the register mark R. Accordingly, the second film F2 can be cut at an appropriate location with high accuracy.

In an example, each of the register mark detection units 122A and 122B and the connection portion detection unit 121 may include a photoelectric sensor. In this case, it is possible to appropriately prevent the connection portion CP from being erroneously detected as the register mark R. Accordingly, the second film F2 can be cut at an appropriate location with higher accuracy.

In an example, the register mark detection units 122A and 122B or the connection portion detection unit 121 may detect a position of the connection portion CP based on a change in an output detection signal. In this case, it is possible to appropriately prevent the connection portion CP from being erroneously detected as the register mark R. Accordingly, the second film F2 can be cut at an appropriate location with higher accuracy.

Although the embodiments of the present disclosure are described above, the present disclosure is not necessarily limited to the embodiments described above, and various changes can be made without departing from the gist thereof. For example, in the embodiment described above, the bagmaking and packaging apparatus may further includes a printing unit that prints on the first film or the second film based on the detection result of the connection portion detection unit. In this case, occurrence of a defective product due to a printing defect of the individual packaging bag can be suppressed.

What is claimed is:

1. A bagmaking and packaging apparatus comprising:

a first holding unit configured to hold a first film roll around which a first film is wound;

a second holding unit configured to hold a second film roll around which a second film is wound;

a transport unit configured to transport the first film or the second film in a film transport direction;

a register mark detection unit configured to detect register marks for position alignment, the register marks being printed on each of the first film and the second film;

a bagmaking and packaging unit configured to make an individual packaging bag, by cutting the first film or the second film by using positions of the register marks detected by the register mark detection unit as a reference after shaping the first film or the second film to form a bag-shaped body in which an article is to be accommodated; and a connection unit configured to form a connection portion for connecting the first film and the second film, wherein in a case where:

in the first film, in the film transport direction, the register mark closest to the connection portion is defined as a first register mark; and in the second film, in the film transport direction, the register mark closest to the connection portion is defined as a second register mark and the register mark located immediately after the second register mark is defined as a third register mark, the bagmaking and packaging unit is configured to cut the second film by using a position of the third register mark as a reference to make the individual packaging bag in a case where a pitch between the first register mark and the second register mark is shorter than a register mark pitch set in advance, and cut the second film by using a position of the second register mark as a reference to make the individual packaging bag in a case where the pitch is longer than the register mark pitch set in advance.

2. The bagmaking and packaging apparatus according to claim 1, further comprising:

a connection portion detection unit configured to detect the connection portion upstream of the register mark detection unit in the film transport direction.

3. The bagmaking and packaging apparatus according to claim 2, wherein each of the register mark detection unit and the connection portion detection unit includes a photoelectric sensor.

4. The bagmaking and packaging apparatus according to claim 2, wherein the register mark detection unit or the connection portion detection unit is configured to detect a position of the connection portion based on a change in an output detection signal.

5. The bagmaking and packaging apparatus according to claim 2, further comprising:

a printing unit configured to print on the first film or the second film based on a detection result of the connection portion detection unit.

* * * * *